United States Patent [19]

Beckerman et al.

[11] 4,323,023

[45] Apr. 6, 1982

[54] INSTRUCTIONAL FLIP PLATE INFORMATIONAL SYSTEM

[75] Inventors: Howard L. Beckerman, Middletown; Allan M. Dob, Clifton, both of N.J.

[73] Assignee: The Singer Company, Stamford, Conn.

[21] Appl. No.: 202,207

[22] Filed: Oct. 20, 1980

[51] Int. Cl.[3] ..... D05B 3/02

[52] U.S. Cl. ..... 112/158 F; 112/158 E; 112/259

[58] Field of Search ..... 112/158 F, 158 E, 121.11, 112/121.12, 258, 259

[56] References Cited

U.S. PATENT DOCUMENTS

| | | | |
|---|---|---|---|
| 3,394,368 | 7/1968 | Carr et al. | |
| 3,600,592 | 8/1971 | Mahan et al. | |
| 4,136,336 | 1/1979 | Abe et al. | |
| 4,236,467 | 12/1980 | Tanaka et al. | 112/158 F X |

*Primary Examiner*—Peter P. Nerbun

*Attorney, Agent, or Firm*—William V. Ebs; Robert E. Smith; Edward L. Bell

[57] ABSTRACT

A sewing machine is provided with a hinging system which supports information bearing plates and a cover therefor. The plates are confined and concealed in a recess in the machine when the cover is closed and can pivot between positions in the recess and positions opposite the rear side of the cover when the cover is open.

11 Claims, 9 Drawing Figures

Fig. 1.
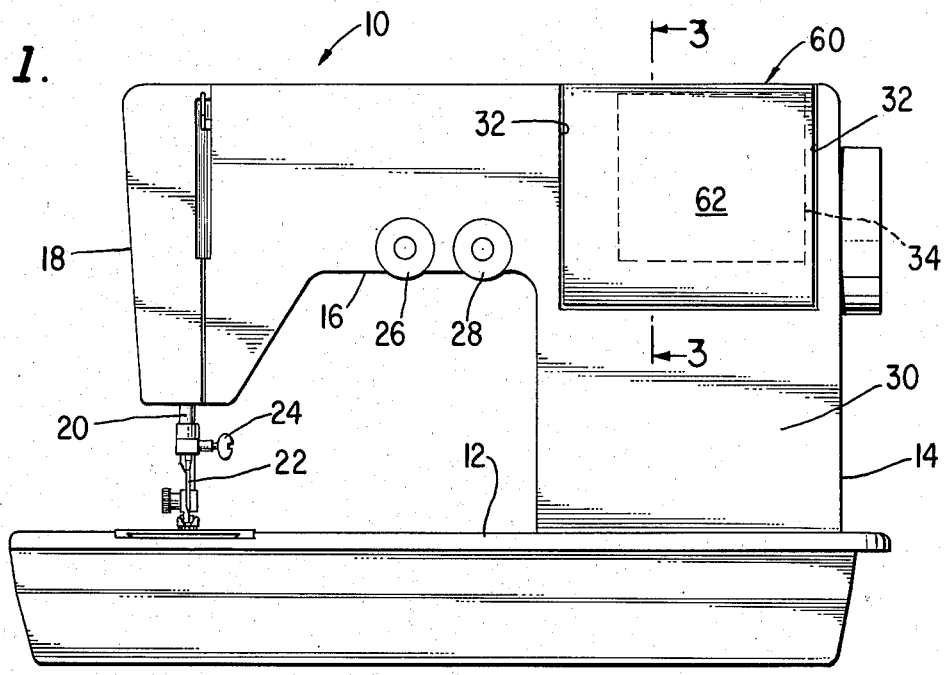
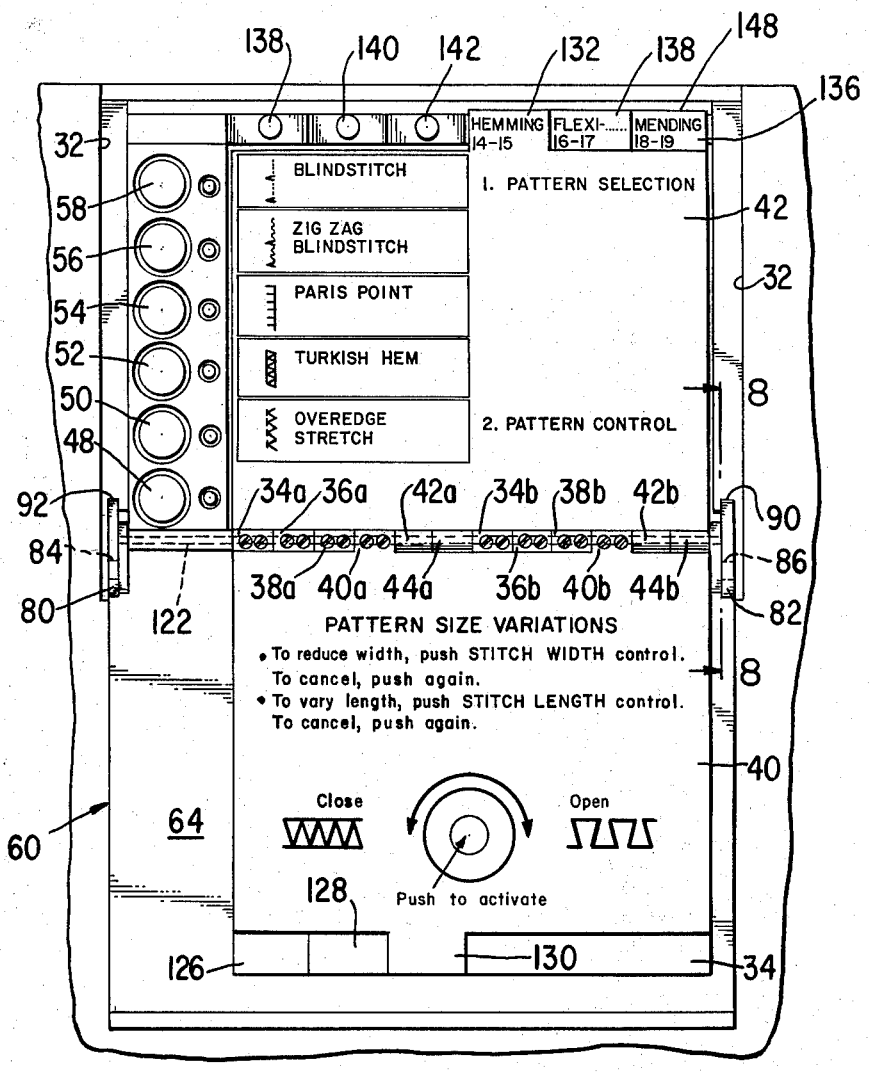
Fig. 2.

Fig. 3.
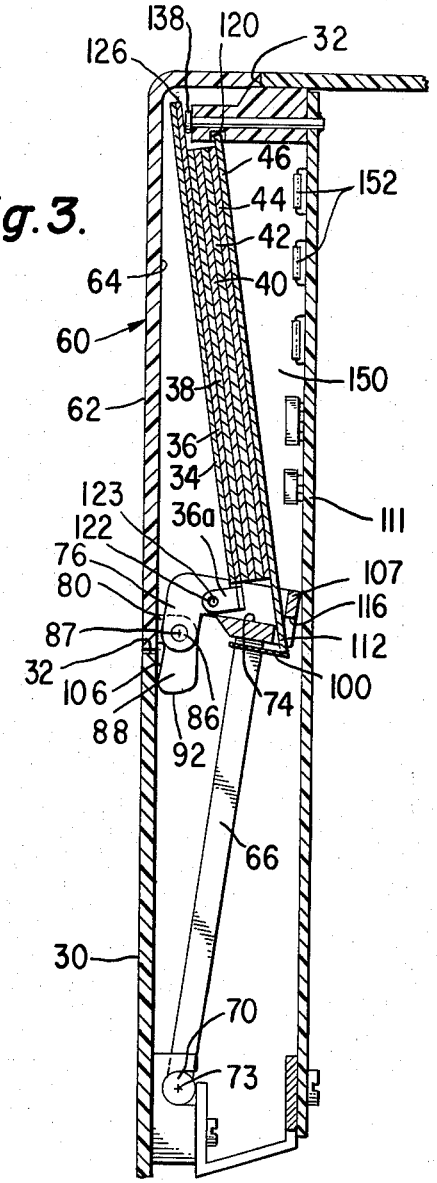
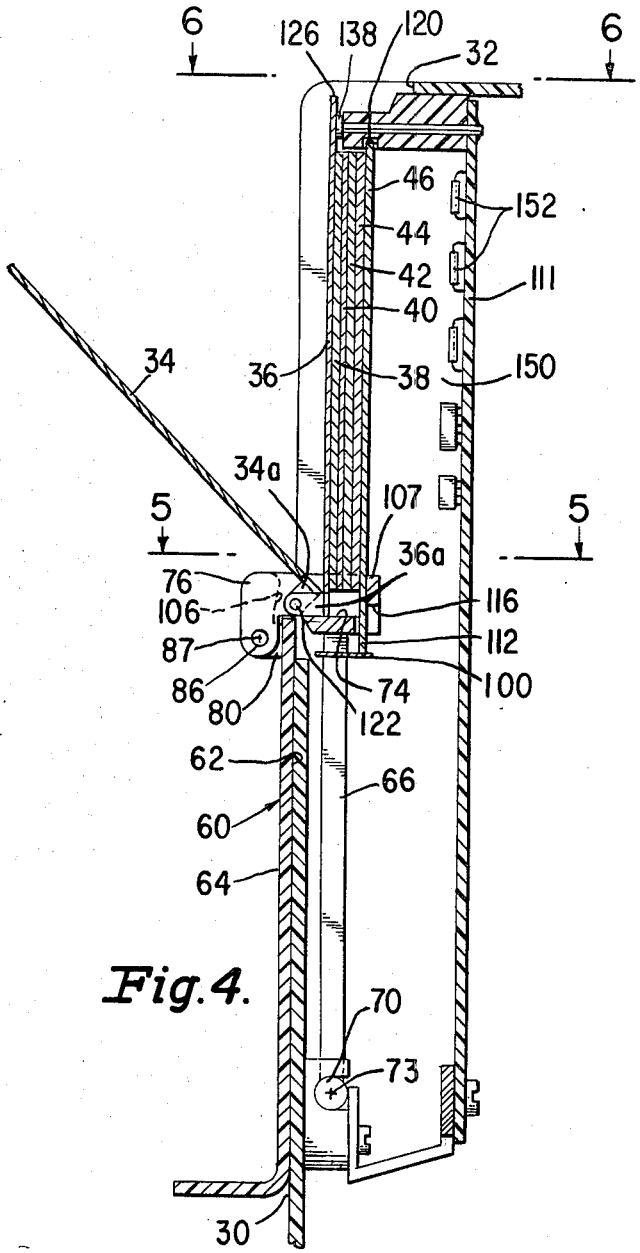
Fig. 4.
Fig. 5.
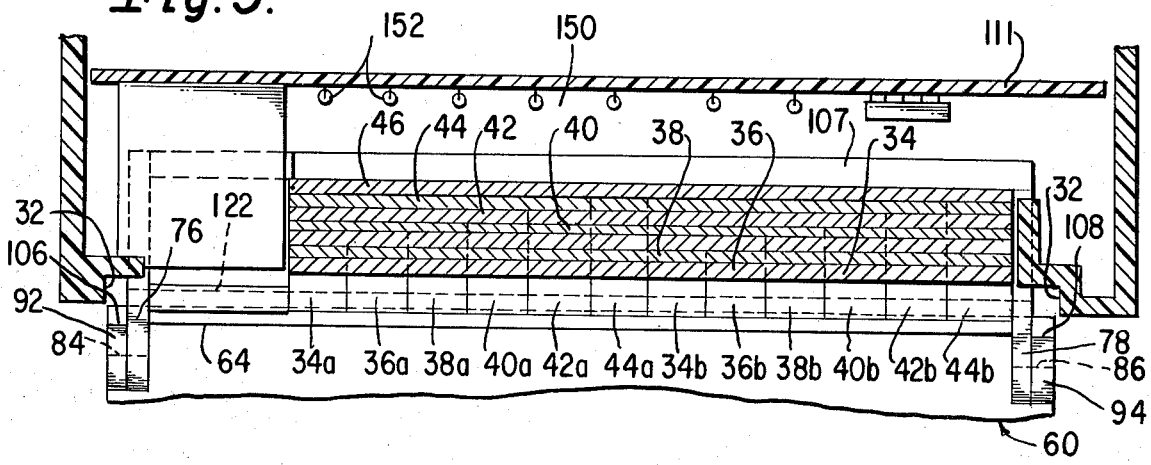

INSTRUCTIONAL FLIP PLATE INFORMATIONAL SYSTEM

BACKGROUND OF THE INVENTION

Field of the Invention

The invention is directed to an instructional flip plate informational system for a sewing machine.

DESCRIPTION OF THE PRIOR ART

Display devices consisting of a number of pages in the form of rigid plates each supported by brackets extending substantially perpendicularly to the plates and pivotally mounted on a common axle have been described heretofore in U.S. Pat. Nos. 943,961 and 1,287,379. However, the axle on which the plates are pivotally mounted isn't movably supported in such a way as to allow the plates to swing between a closed position in which they are substantially parallel to each other and an open position in which they are also substantially parallel to each other as well as to the surface of a pivotally mounted cover and a rigid support member on which both the cover and the plates are mounted by transversely movable support means.

U.S. Pat. No. 2,909,761 shows a phonograph selection mechanism that has two pivotally mounted pages offset from a common axle, but the pages aren't offset so as to be parallel to a cover or a rigid support member, either in a closed or an open position.

U.S. Pat. No. 3,600,592 shows a keyboard system in which apertured books are inserted. The pages of the books are affixed to binder elements that hold each page offset from the adjacent page by a distance equal to the thickness of the page so that the pages are parallel to each other whether they are pivoted to the right or to the left. However, the pivotal axis of the pages doesn't move transversely in order to shift the book between an exposed position and a covered position.

OBJECTS AND SUMMARY OF THE INVENTION

One of the objects of the present invention is to provide an improved flip plate informational display system for a sewing machine with a hinge arrangement that permits the display system to be exposed or hidden from view.

Another object is to provide a flip plate informational display system which includes a pivotally mounted cover positionable in a common plane with the standard of a sewing machine, and further includes a plurality of pivotally mounted information bearing plates so arranged on a common axis that they are parallel to each other within a recess behind the cover member when the latter is closed and can each swing to an alternative, open position parallel to each other and to the cover member when the cover member is pivoted to an open position.

A further object of the invention is to provide a pivotally mounted support for moving axle means for a pivotally mounted cover into and out of a recess in the standard of a sewing machine and for supporting a plurality of informational flip plates.

A still further object of the invention is to provide a removable cover plate for a cavity located within the outline of the said recess, and to hold such cover plate in place by resilient means carried on the pivotally mounted axle support.

In accordance with the present invention, the standard of a sewing machine is provided with a pivotally mounted cover that can move between a closed position substantially flush with the front surface of the standard, and an open position substantially 180° removed from the closed position and again flush with the front surface of the standard but in juxtoposition to the latter rather than in line with it. Various switches for controlling stitch forming components of the sewing machine are hidden behind the cover when the latter is in its closed position. These switches and a plurality of flip plates that have information on them to describe various functions that can be performed on the machine are in a recess in the support member.

The cover is pivoted on axle means mounted on brackets that retract behind the front surface of the standard when the cover is in its closed position but extend outwardly from said front surface when the cover is in its open position. Separate axle means for the flip plates attached to the same brackets that support the axle means for the cover moves forward as the bracket moves. The axle means for the cover and the axle means for the plates are parallel to each other and close together. Each of the flip plates is supported on the plate axle means by a pair of support members that extend substantially perpendicularly from the plate, and each of these pairs of support members has a length that differs from the length of the pair of support members of the next adjacent plate by an amount substantially equal to the thickness of the next adjacent plate. This permits the plates to stack substantially parallel to each other, one behind the other within the recess in the standard member and to be pivoted out of the recess to lie in a second stacked position substantially parallel to each other and to the cover member in the open position of the latter.

The brackets that support the axle means that holds the cover, and also supports the axle means for the flip plates, are part of a support which is pivotally supported adjacent the inner surface of the standard at a location substantially removed from the location of the two axles. Such support is only required to pivot a relatively small number of degrees in order to move the flip plate axle means and the cover axle means between their respective retracted and exposed positions.

DESCRIPTION OF THE DRAWINGS

FIG. 1 is a front elevational view of a sewing machine including the flip plate informational system of the invention;

FIG. 2 is an enlarged front elevational view showing certain informational bearing flip plates of the system in a recess in the machine and showing the other flip plates against an open flip plate cover;

FIG. 3 is a sectional view along the plane of the line 3—3 of FIG. 1 showing all of the flip plates in the recess in the standard and the flip plate cover closed;

FIG. 4 is a sectional view similar to FIG. 3 showing the flip plate cover open and a plate being pivoted downwardly toward the open cover;

FIG. 5 is a sectional view taken on the plane of the line 5—5 of FIG. 4 showing all of the flip plates in the recess in the machine;

DESCRIPTION OF THE PREFERRED EMBODIMENT OF THE INVENTION

Figure 6:
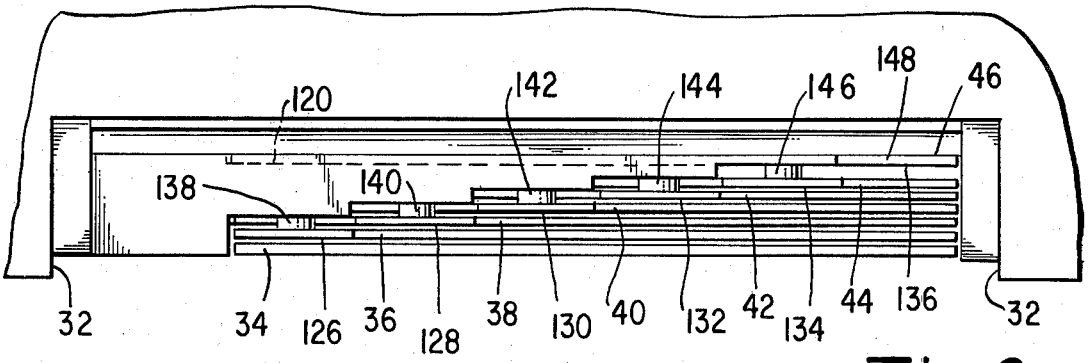
FIG. 6 is a view taken on the plane of the line 6—6 of FIG. 4 showing all of the flip plates in the recess in the machine.

Referring to the drawings, reference character 10 designates a sewing machine including a work supporting bed 12, a standard 14, a bracket arm 16, and sewing head 18. The sewing head 18 carries a needle bar 20 for endwise reciprocation and the needle bar has a sewing needle 22 secured thereto by a thumb screw 24. Operator controls include a stitch length control 26 and stitch width control 28 in the bracket arm 16.

The standard 14 is formed with a flat front outer surface 30, and with a recess 32 in the front upper portion for pivoted information bearing plates 34, 36, 38, 40, 42, 44 and 46, and for operator controls 48, 50, 52, 54, 56 and 58. A cover 60 having flat outer and inner surfaces 62 and 64 is provided for the plates and controls. The cover is mounted so that it may be moved between a closed position (FIGS. 1 and 3) over the recess in which the flat outer surface 62 of the cover is coplanar with the flat outer surface 30 of the standard, and an open position (FIGS. 2 and 4) wherein the flat outer surface of the cover lies opposite the flat outer surface of the standard.

Mounting means for the cover includes cover support means pivoted within the standard at locations remote from the bottom edge of recess 32. Such support means is shown as an integral structure including a pair of elongated support members 66 and 68 pivoted at 70 and 72 respectively for movement about an axis 73 parallel to the bottom edge of recess 32, a rigid shelf 74 extending between the members, and brackets 76 and 78 at opposite ends of the shelf. The mounting means for the cover further includes brackets 80 and 82 which project from the inner surface of the cover, and axle means at 84 and 86 which connect the brackets 76 and 78 with the brackets 80 and 82 respectively to render the cover pivotally movable on the cover support means about an axis 87 parallel to the pivotal axis 73 of the elongated support members and the bottom edge of recess 32.

Figure 8:
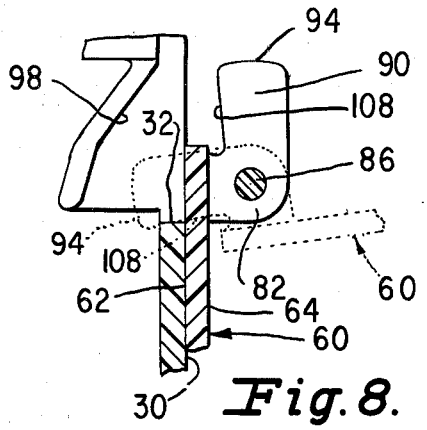
FIG. 8 is an enlarged fragmentary sectional view taken on the plane of the line 8—8 of FIG. 2, and showing the flip plate cover both in an open and a partially closed position.
Figure 9:
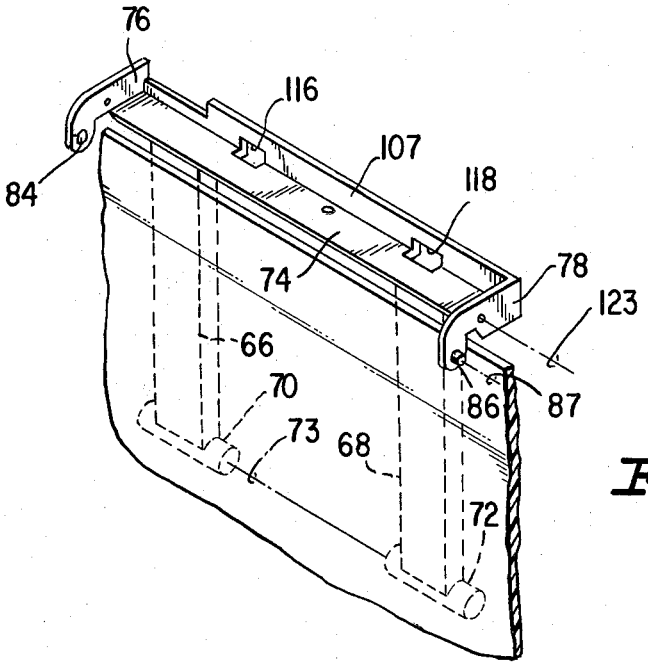
FIG. 9 is a fragmentary perspective view showing the flip plate cover support structure in a forward position in the machine.
Figure 7:
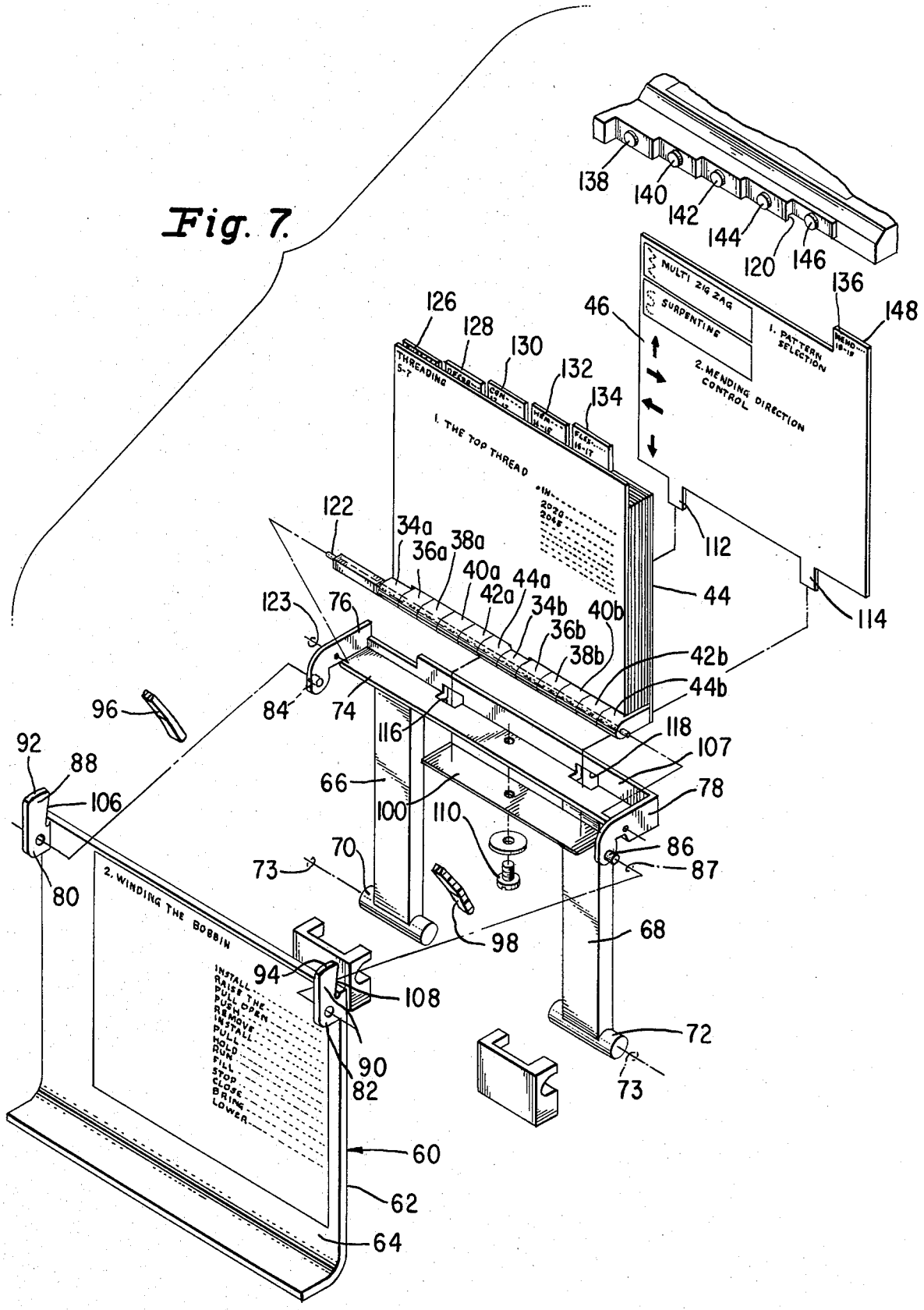
FIG. 7 is an exploded perspective view showing the hinge mechanism of the invention.

Brackets 80 and 82 on the cover include extended portions 88 and 90 with ends 92 and 94 respectively. The bracket ends 92 and 94 engage camming surfaces 96 and 98 respectively on the standard within recess 32 as cover 60 is moved by a machine operator from a closed position toward an open position, and the cover support means is thereby caused to pivot forwardly, that is toward the operator, about the pivotal axis 73 of elongated support members 66 and 68. The forward movement of the cover support means results in the pivotal axis 87 of the cover being moved away from a retracted position (FIG. 3) in the machine and out of recess 32 into a position (FIG. 4) permitting the cover to be moved freely to a full open position opposite outer surface 30 of the standard. When the cover 60 is closed, edges 106 and 108 of cover brackets 80 and 82 respectively are caused to engage the bottom edge of recess 32 (FIG. 8), and the cover support means is pivoted inwardly. As the cover is fully closed the cover support means and pivotal axis of the cover resume their FIG. 3 retracted positions defined by the engagement of a flange 107 on shelf 74 with a fixed panel 111 in the machine.

As shown, a leaf spring 100 is affixed by a screw 110 to shelf 74 and is engaged by projections 112 and 114 on plate 46 extending through shelf apertures 116 and 118 respectively. The spring biases plate 46 upwardly in recess 32 to normally maintain the upper edge of the plate in a groove 120 in the standard.

An axle 122 extending parallel to, but offset rearwardly from the pivotal axis of the cover is supported in brackets 76 and 78 of the cover support means. The axle 122 defines a pivotal axis 123 for plates 34, 36, 38, 40, 42 and 44 each of which has thereon a pair of support projection (indicated in the drawings by the reference character of the plate and accompanying lower case letters a and b) mounted on the axis. Such support projections 34*a*, 34*b*; 36*a*, 36*b*; 38*a*, 38*b*; 40*a*, 40*b*; 42*a*, 42*b*; and 44*a*, 44*b* extend perpendicularly from axle 122 to lower edges of the plates through a distance that increases from plate to plate by an amount enabling the plates when the cover is open to be stacked flat against one another either in a position against removable plate 46 in recess 32 or in a position against the inside surface 64 of cover 60, and to be sequentially pivoted between alloted positions in the stacks.

Plates 36, 38, 40, 42, 44 and 46 include upper edge tabs 126, 128, 130, 132, 134 and 136 respectively. The tabs 126, 128, 130, 132, and 134 are located on the plates to align with fixed members 138, 140, 142, 144, and 146 in recess 32 where each one of the fixed members is offset from the next adjacent member to engage the pivotable plate with which it is aligned while such plates are stacked flat in recess 32 against the removable plate 46. It is preferable that the plates 36, 38, 40, 42 and 44, or at least the tabs thereon, be formed of a ferromagnetic material, and that the fixed members 138, 140, 142, 144 and 146 be magnetically polarized so as to attract the tabs and assist in retention of the plates in recess 32 when stacked therein.

The tabs 126, 128, 130, 132 and 134 facilitate the flipping of plates 36, 38, 40, 42 and 44 respectively about their pivotal axis with the fingers, and tab 136 provides an available edge 148 on plate 34 where finger pressure can be applied to move the plate downwardly against spring 100 and out of groove 120, after which the plate can be moved forwardly and withdrawn from the recess 32 to lay open a cavity 150 wherein there are electrical components 152 of the machine.

Each of the tabs 126, 128, 130, 132 and 134 includes an identifying term, visible in the stacked position of the pivotal plates in recess 32, indicating the type of instructional information which is included on the plate to which the tab belongs. Plate 34 which is without a tab is provided with an identifying term visible in the upper left corner of the plate as viewed in FIGS. 1 and 2. Both sides of each of the plates 34, 36, 38, 40, 42 and 44 have instructional information thereon concerning the operation of the machine so that one side can be read when the plate is in recess 32 whereas the other side can be read after the plate has been flipped downwardly about its pivotal axis. Removable plate 46 which is normally maintained in place in recess 32 contains instructional information only on the front side. The rear of the cover 60 also contains instructional information which is visible when the cover is open. The instructional information on the plates includes instructions concerning the operation of controls 48, 50, 52, 54, 56 and 58 which are exposed when the cover 60 is open and concealed along with the various plates when the cover is closed.

While the cover support means of the drawings including the elongated members 66 and 68, shelf 74, and the brackets 76 and 78 is shown as having a pivotal axis near the bottom the standard 14, it is of course possible to utilize a cover support structure which is arranged to pivot on an axis near the top of the machine. Other possible changes and modifications will also be apparent to those skilled in the art, and all such changes and modifications which do not depart from the spirit and scope of the invention are intended to be included within the scope of the appended claims.

We claim:

1. In a sewing machine, a standard with a recess and a substantially flat outer surface adjacent thereto; a cover for the recess including substantially flat inner and outer surfaces; means mounting the cover for movement between a closed position over the recess in which the flat outer surface of the cover is substantially coplanar with the flat outer surface of the standard, and an open position wherein the flat outer surface of the cover lies opposite the flat outer surface of the standard, said mounting means including cover support means pivoted within the standard at a location remote from the bottom edge of the recess for movement about an axis substantially parallel thereto, and extending to a region within the recess in the standard where the support means includes support brackets extending toward the cover, said mounting means further including brackets extending from the inner surface of the cover, and axle means connecting the brackets from the support means with the brackets from the cover to render the cover pivotally movable on the support means about an axis parallel to the pivotal axis of the support means and said bottom edge of the recess; a plurality of information bearing plates in said recess; axle means supported in the brackets of the elongated support means and extending parallel to the pivotal axis of the cover but offset therefrom; support projections on the plates mounted on the offset axle means to extend perpendicularly therefrom to a first edge of the respective plate through a distance that increases from plate to plate by an amount enabling the plates when the cover is open to be stacked flat against one another either in said recess or against the inside surface of the cover, and moved sequentially between alloted positions in the stacks; a tab on each of at least selective ones of the pivoted informational plates on a second edge remote from the said first edge of the plate; and fixed members in said recess aligned with respective tabs and off-set from each other to engage the aligned tabs when the plates are stacked flat in said recess.

2. The combination of claim 1 wherein the cover brackets include extended portions engageable with the standard at the recess as the cover is closed to cause the cover support means to be pivoted rearwardly and the pivotal axis of the cover to be moved from a position outside the recess to a retracted position in the standard.

3. The combination of claim 1 wherein the cover brackets include extended portions and the standard includes cam means in the recess engageable with the extended portions of the cover brackets as the cover is opened to cause the cover support means to be pivoted forwardly and the pivotal axis of the cover to be moved from a retracted position in the standard to a position outside the recess.

4. The combination of claim 1 wherein the fixed members engageable with tabs are magnetically polarized and the tabs are ferromagnetic.

5. The combination of claim 1 including a cavity in the standard within the outline of the recess, and a removable plate mounted in the standard to close the cavity.

6. The combination of claim 5 wherein the removable plate is an information bearing plate.

7. The combination of claim 5 wherein the standard includes a groove in which an edge of the removable plate is received and the cover support means carries resilient means which bears against another edge of the removable plate to press the plate in said groove.

8. The combination of claim 7 wherein the resilient means is a leaf spring.

9. The combination of claim 8 including a shelf which interconnects the support brackets of the cover support means, the leaf spring being affixed to a bottom side of the shelf, said removable plate having projections along the said another edge thereof and the shelf including apertures through which the plate projections extend to engage the spring.

10. The combination of claim 9 wherein the spring is centrally attached to the shelf and extends substantially parallel to the pivotal axis of the cover.

11. The combination of claim 1 wherein the standard carries operator sewing machine controls which are adjacent the plates in said recess and concealable by the cover.

* * * * *